United States Patent [19]

Cowan et al.

[11] 4,323,426

[45] Apr. 6, 1982

[54] CRAFTED PAPER MAKING MACHINE

[75] Inventors: Wavell F. Cowan, Montpelier; Marshall S. Green, Waterbury Center, both of Vt.; Stanley E. McGurk, Westmount, Canada

[73] Assignee: Inotech Process Ltd., Quebec, Canada

[21] Appl. No.: 93,743

[22] Filed: Nov. 13, 1979

[51] Int. Cl.[3] ..... D21J 3/12

[52] U.S. Cl. ..... 162/398; 162/399; 162/407

[58] Field of Search ..... 425/84, 85, 361; 162/382, 392, 396, 398, 399, 407, 408, 410

[56] References Cited

U.S. PATENT DOCUMENTS 3,275,498 9/1966 Roth et al. ..... 162/392

3,373,079 3/1968 Eastman et al. ..... 425/84

*Primary Examiner*—Peter Chin

*Attorney, Agent, or Firm*—Stevens, Davis, Miller & Mosher

[57] ABSTRACT

A method and apparatus for custom making paper comprising a filter like carrier substrate which is moved sequentially past a series of stations including a station wherein a liquid bearing solids in suspension is passed through the filter like carrier such that the solids form a paper sheet on the substrate carrier, moving the carrier with the deposited solids to a second stage where pressure is applied to the sheet to consolidate the solids into a sheet, further moving the carrier to a third station and exposing the sheet to heat for drying the sheet, finally moving the carrier to a fourth station and removing the so formed sheet from the carrier.

13 Claims, 5 Drawing Figures

CRAFTED PAPER MAKING MACHINE

BACKGROUND OF THE INVENTION

1. Field of the Invention

The present invention relates to a method and apparatus for making paper.

2. Description of the Prior Art

Present day paper making techniques are geared to large volume, low-cost classes of paper. The higher quality of these mass-produced papers are used for correspondence, letter writing, product marketing brochures, etc. At the other end of the scale, such lower grade papers are used for newspapers, etc.

Prior to the invention of the Fourdrinier paper machine by Nicolas Louis Robert in 1800, paper was mostly made by hand. Although the volume of such hand-made paper was small, the making of it was greatly decentralized. Of course, the quality of paper depended on the craftsman who made the paper, and a large variety of aesthetic papers could be produced by these individual craftsmen. Since the advent of the printing press and the Fourdrinier paper making machine, the hand-crafted paper maker has all but been eliminated except for a few artists who still produce unique hand-made papers or extremely small volume printings of artistic drawings or writings.

In hand-crafted paper making, the craftsman or artist can control and select the appropriate materials which in the paper making process are in suspension in a water carrier and are then filtered and deposited on a supported substrate to form the sheet of paper. The craftsman, therefore, can select the type of material and can also introduce textural effects to the already formed paper.

SUMMARY OF THE INVENTION

It is an aim of the present invention to provide a method of making custom sheet paper of consistent predetermined quality.

It is an aim of the present invention to provide an apparatus for automatically forming sheet paper having desirable aesthetic craft paper qualities; or any other properties that may be desired.

A method in accordance with the present invention includes the steps of providing a filter-like carrier substrate and introducing the substrate into a first stage, passing a liquid, bearing solids in suspension, through the filter-like carrier such that the solids to form the paper are deposited on the filter-type substrate carrier, moving the carrier with the deposited solids to a second stage where pressure is applied to the sheet on the substrate carrier, moving the carrier carrying the sheet to a third stage, for drying the sheet, and finally moving the carrier to a fourth stage, removing the so-formed sheet from the carrier and repeating these steps.

An apparatus in accordance with the present invention includes a carrier means provided with a flat filtering medium and having an area suitable for forming a desired sheet of paper, conveying means for moving the carrier sequentially through treatment stations, the first station including means for passing and drawing a liquid containing solids in suspension therein, through the filter medium of the carrier whereby the solids are deposited on the carrier, a second station where a differential pressure is applied on both sides of the carrier such that excess liquid is drained through the filter medium of the carrier whereby the sheet is consolidated on the carrier, a third station including means for drying the sheet, and means for removing the so-formed sheet from the carrier.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENT

Figure 1:
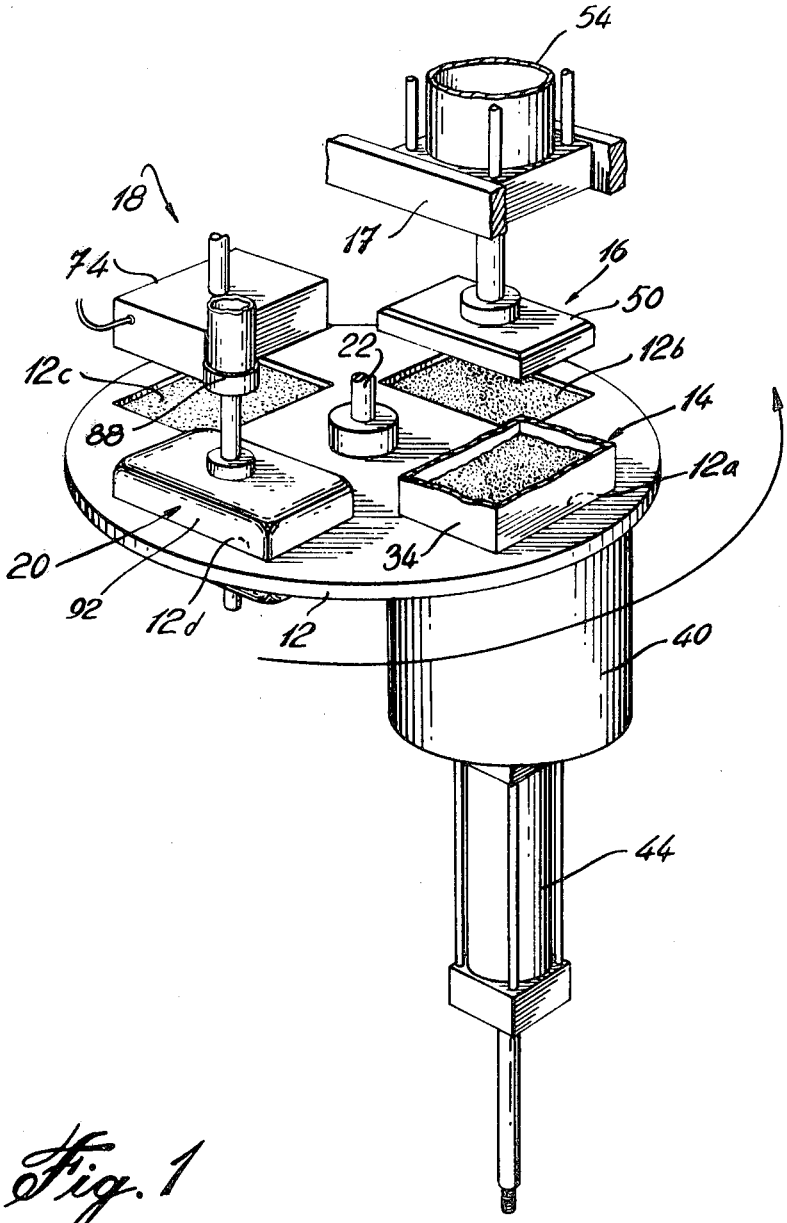
FIG. 1 is a fragmentary perspective view of the apparatus.

Referring now to the drawings, there is shown a frame 10 mounting a turntable 12 having four separate carrier sections defined by screen substrates 12*a*, 12*b*, 12*c* and 12*d*. The screen substrates 12*a*, 12*b*, 12*c* and 12*d* are illustrated in operative positions at each of the stations 14, 16, 18 and 20.

The turntable 12 which includes the screen substrates 12*a*, 12*b*, 12*c* and 12*d*, is mounted on a shaft 22. Shaft 22 is itself journalled in a bearing 24 and is connected to a pneumatic piston and cylinder arrangement 28 adapted to lift the shaft 22 and thus the turntable 12. The top end of shaft 22 is operatively connected in a torque device 32 which is also pneumatically controlled to turn the shaft 22 and thus the turntable 12 intermittently through 90° arcs. The torque device 32 is mounted on a bracket 30 which in turn is mounted to the frame 10.

Accordingly, it can be seen that the shaft and the turntable 12 can be made to rotate in a horizontal plane through 90° arcs and by controlling the piston and cylinder arrangement 28, shaft and turntable can also be lifted a short distance just prior to the turntable 12 being rotated through its 90° arc and then the piston and cylinder arrangement 28 can be operated to lower the turntable such that the screen substrates will be lowered and keyed into stations 14, 16, 18 and 20.

Figure 5:
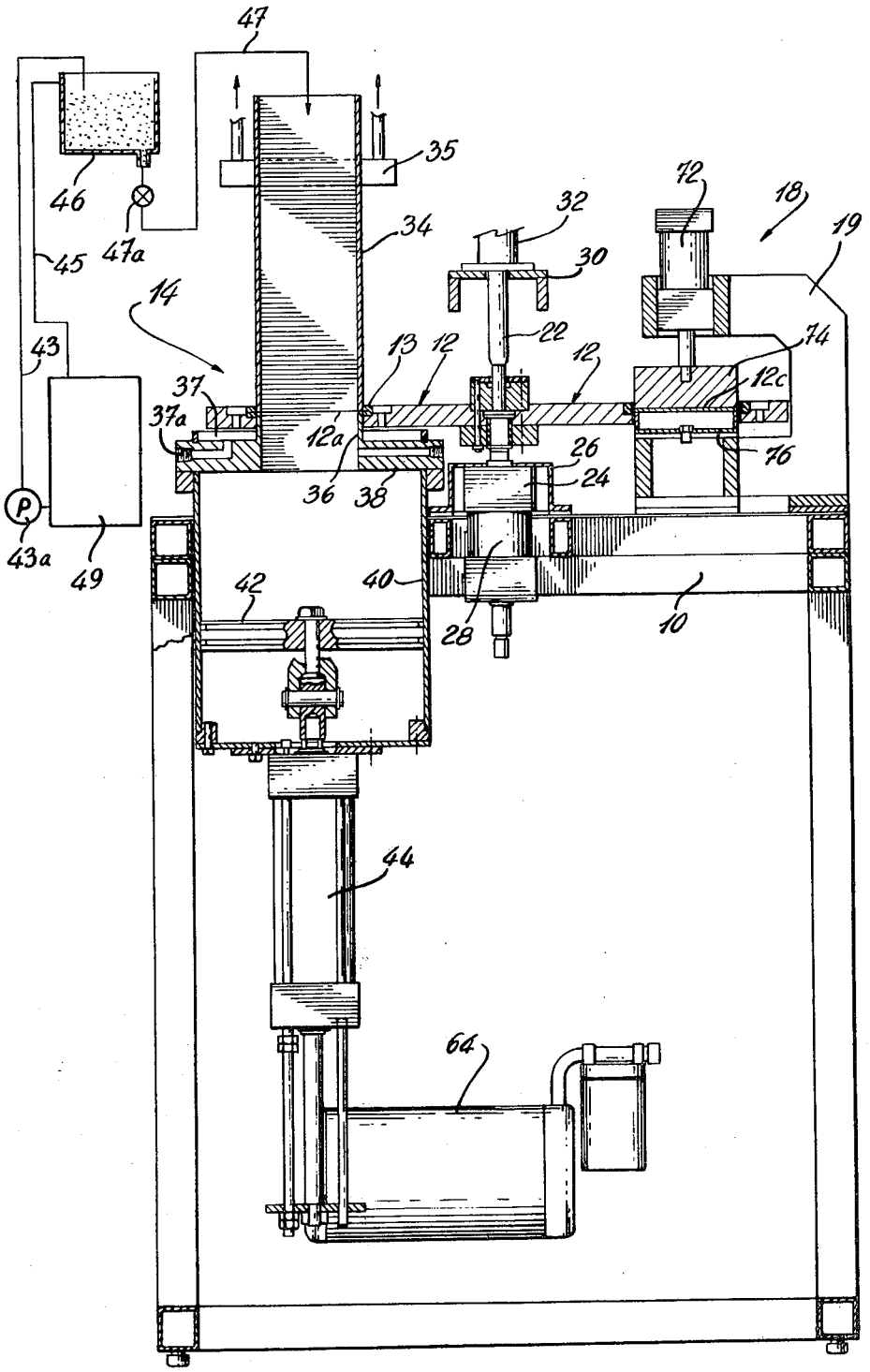
FIG. 5 is a vertical cross-section taken along lines 5—5 of FIG. 2.

Referring to the first station 14 as seen more clearly in FIG. 5, there is provided a column forming a container 34 for liquid. The column is mounted to a frame 35 which can be moved along a vertical axis over the screen substrate when a typical screen substrate 12*a* is keyed in station 14. The column 34 has an open bottom and is adapted to be seated on a suitable gasket 13 surrounding a typical screen substrate 12*a*.

A measuring tank 46 shown schematically in FIG. 5 is provided over the column 34 and is connected to the column 34 by means of a flexible conduit 47 which is opened by valve 47*a*. A mixing tank 49 is adapted to receive and to mix the fibers and a liquid carrier ie. pulp fibers mixed in water called the stock. The stock is continually recirculated to measuring tank 46 by means of conduit 43 and pump 43*a*. A return conduit 45 is also provided for returning the overflow stock to the mixing tank 4*a*.

Below the column 34, there is provided a large piston and cylinder arrangement 40 which has a lid 38 and a collar 36 adapted to coincide just below the gasket once the screen 12*a* is seated in station 14. The collar 36 is a continuation therefore of the column 34 when the column 34 is in its lowest position. A piston 42 is provided in the cylinder 40 in hermetical contact with the walls of the cylinder 40 such that when it is pulled downwardly it will forcibly draw the water through the screen 12*a* into the cylinder 40.

A drain channel 37 with an outlet 37*a* is also provided for draining away the excess liquid as will be described.

In operation, the cycle will be described with the piston 42 at the end of its downward stroke. Water devoid of the fibers is now within the container 40 and a screen 12 on the top of which are fibers, has been moved on with the column 34 in a raised position. The piston 42 begins its upward stroke pushing the water upwardly into the collar 36 to overflow into the drain channel 37. When the piston 42 reaches a given position in its upward stroke movement it will trigger a limit switch (not shown) which will stop the piston leaving a predetermined volume of water in the container 40. At the same time, a new screen 12*a* has been moved into place over the collar 36 and the column 34 is moved downwardly to be sealingly fitted about the screen 12*a*. At this point, the piston 42 is again activated to continue its upward stroke movement pushing the water in the container 40 upwardly in the column 34. At the same time, the valve 47*a* is activated to allow a batch of concentrated stock to be emptied into the column 34. The amount of stock in the measuring tank 46 is controlled accurately by the overflow position of the return conduit 45. The concentrated stock is mixed with the water which has been passed upwardly into the column 34 and the predetermined concentration of stock as thus provided in the column 34. Once the piston 42 has reached its upper most position, and its upward stroke, it then begins its downward stroke drawing the water containing the pulp fibers downwardly leaving and depositing the pulp fibers on the screen 12*a*. The piston 42 will draw all the water from the stock down into the container 40 by the time it reaches its downward position prepared for a new cycle.

Figure 3:
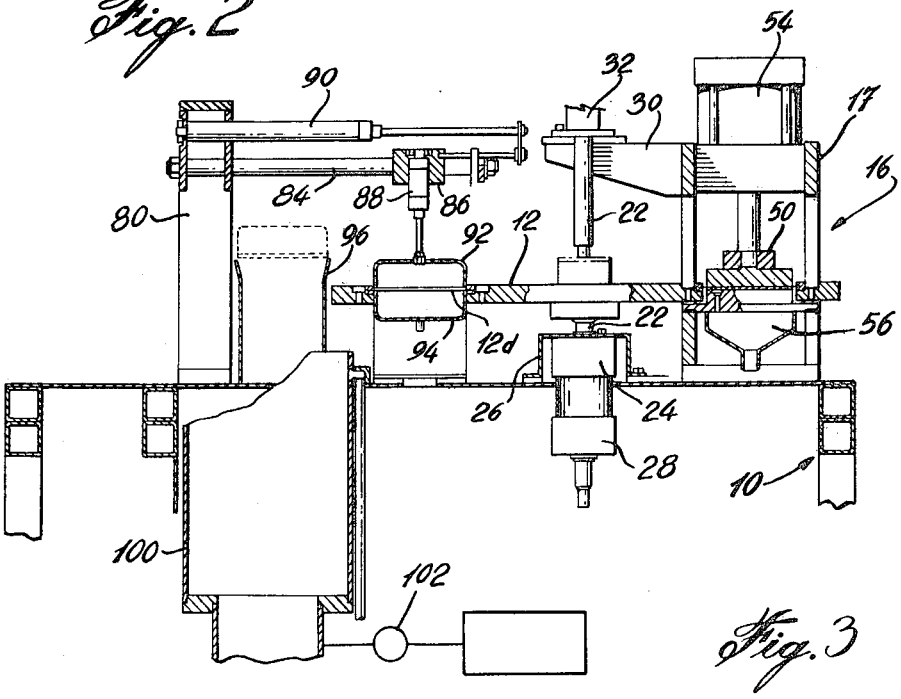
FIG. 3 is a vertical cross-section taken along lines 3—3 of FIG. 2.
Figure 4:
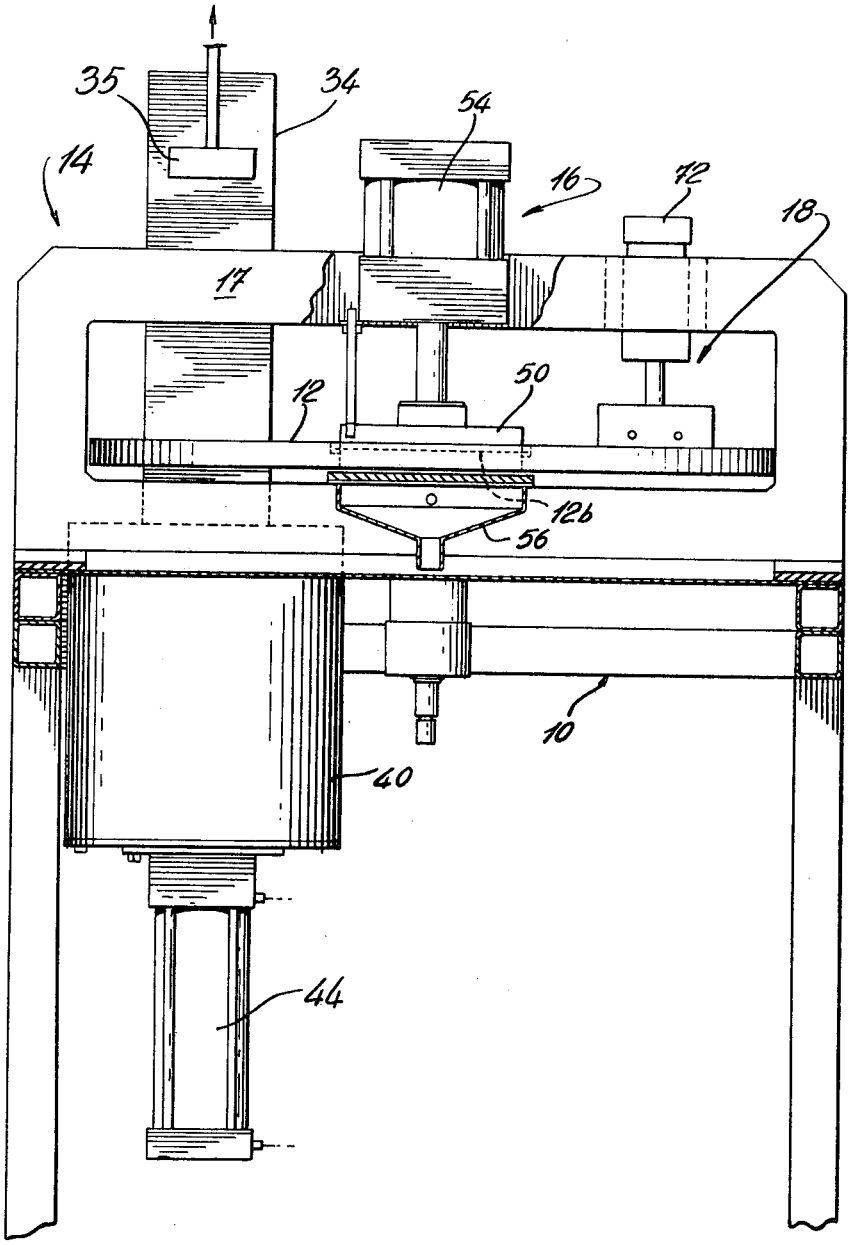
FIG. 4 is an end elevation partly in cross-section taken along lines 4—4 of FIG. 2.

Station 16 is better illustrated in FIGS. 3 and 4. Station 16 is provided with an upright frame 17 to which the frame bracket 30 is mounted, and includes an overhead piston and cylinder arrangement 54 to which a platen 50 is mounted. The platen 50 would normally have the surface which is in the form of the relief which would be required on the finished sheet of paper. If the sheet of paper is to be completely flat then the platen would be flat. In addition, underneath the screen 12*b* in this case, there is provided a suction box 56 which is in communication with a vacuum pump arrangement 64, the station 18 is the forming station wherein the platen 50 is lowered on to the screen 12*b* containing the fibers which would have been placed thereon at station 14.

The air pressure from the platen 50 as well as the suction drawn below the screen enhances the dewatering of the fibers and the consolidation of the fibers in a sheet on the substrate 12*b*.

Referring now to station 18 as illustrated in FIGS. 4 and 5, there is shown a support frame 19 to which is mounted a lifting piston and cylinder arrangement 72 which is provided for the purposes of lifting the heating plate 74. The heating plate 74 is adapted to move downwardly onto the sheet formed on the screen 12*c* which has been previously formed at station 16. A vacuum box 76 is also provided below the screen 12*c* for enhancing the drying of the sheet station 18.

In operation, the turntable 12 is of course raised and rotated such that the screen 12*c* is in a keyed position and the turntable has been lowered. The heating plate 74 which is electrically heated is then lowered onto the sheet for the purpose of drying the sheet. Vacuum is applied to the suction box 76 further reducing the time required to dry the sheet. Once a predetermined time lapse has passed, the vacuum is broken when the heating plates 74 are raised by the piston and cylinder arrangement 72 and the turntable 12 is free to be lifted and to rotate to the next position.

Figure 2:
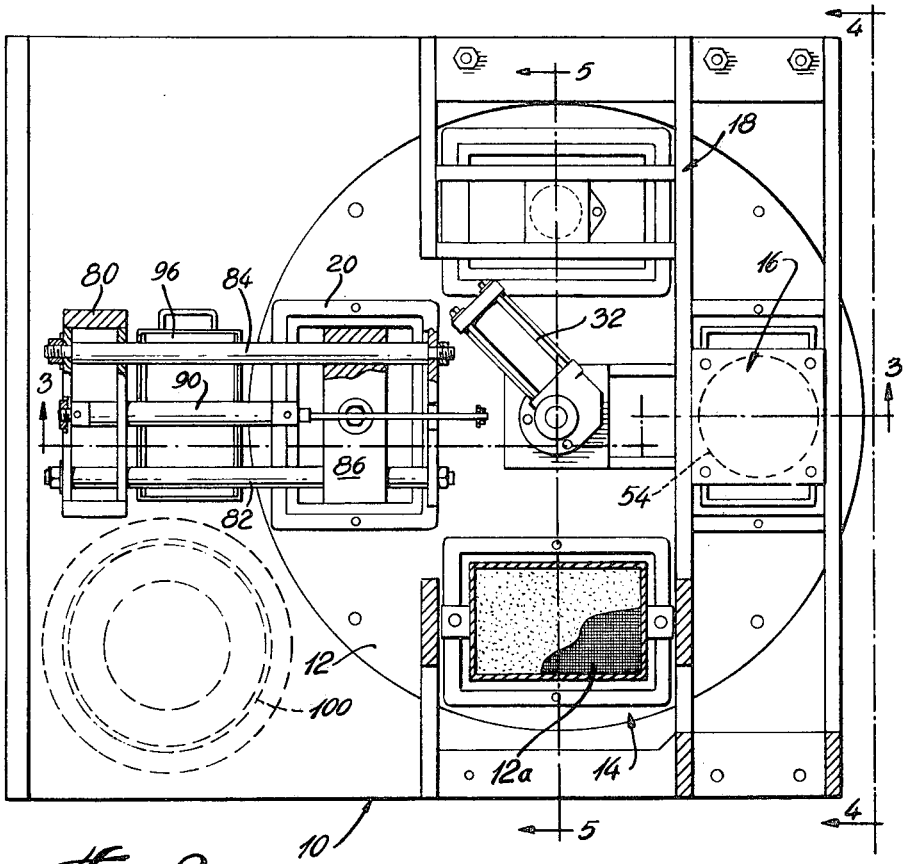
FIG. 2 is a top plan view of an embodiment of the apparatus in accordance with the present invention.

The next and final station is station 20 which is adapted to remove the sheet from the screen substrate and place it in a stacking hopper 96. The station 20, best seen in FIGS. 2 and 3, includes an upstanding support frame 80 to which are mounted guide rails 82 and 84. The carriage 86 is mounted for sliding movement on the rails 82 and 84. A piston and cylinder arrangement 88 is mounted to the carriage 86 and is adapted to lift and lower a vacuum pick-up device 92. The carriage is controlled by means of the piston and cylinder arrangement 90 which move the carriage 86 and thus the vacuum pick-up device 92 between a position over the sheet on the screen substrate 12*d* and a position over the stacking hopper 96. An air pressure box 94 is located at station 20 below the screen substrate 12*d*. In operation, air pressure is forced into the box 94, through the porous surface, to the screen 12*d* thus disengaging the sheet from the screen 12*d*. At the same time, vacuum pressure is applied through the vacuum pick-up device 92 so that the pick-up device 92 will lift the sheet from the screen 12*d*. The piston and cylinder arrangement 88 is retracted so as to lift the pick-up device 92 and then the piston and cylinder arrangement 90 is retracted to move the pick-up device to a position shown in dotted lines over the stacking hopper 96.

When the pick-up device 92 is located over the stacking hopper 96, the vacuum is cut thereby allowing the sheet to fall into the hopper and the cycle is reversed.

An air pressure receiver 100 is provided for supplying air pressure to the various piston and cylinder arrangements as well as to the pressure box 94 and the platen 50. The air pressure receiver communicates and is supplied by the compressor 102. Likewise, a vacuum chamber 64 is provided which communicates with the various vacuum boxes such as a pick-up device 92 in station 20 and a vacuum box 56 in station 16.

As can be seen from the drawings and the above description, the paper making process follows three steps and is withdrawn from the operation at the fourth station 20. The turntable 12 is indexed to move in 90° arcs such that the screen 12*a* for example after receiving the fibers would then advance to station 16 for consolidating of the fiber and then to station 18 for drying. The same sheet would then be picked-up at station 20 from the screen 12*a*. As screen 12*a* is passing through the various steps simultaneously the screens 12*b*, 12*c*, 12*d* are in different stations.

We claim:

1. An apparatus for forming paper comprising:

at least one carrier provided with a filter medium defining a mold suitable for forming a sheet of paper;

means for conveying said carrier sequentially to first, second, third, and fourth treatment stations, said means comprising a turntable mounted for rotation about a vertical axis, whereby said carrier is rotated into each of said stations;

said first station including means for supplying a fiber suspension liquid to said filter medium and means for drawing said liquid through said filter medium whereby the fibers are left on said mold forming a sheet;

said second station comprising means for applying a pressure against said formed sheet whereby excess liquid is forced from said sheet through said filter medium;

said third station comprising heating means for drying the sheet whereby a removable sheet of paper is obtained from said mold; and said fourth station comprising a sheet pickup means adjacent the turntable and adapted to pickup and remove the sheet from the mold.

2. An apparatus as defined in claim 1, wherein a plurality of carriers are mounted on the turntable at spaced apart locations on the turntable, the stations having a circular locus and means for rotating the turntable to simultaneously move the carriers in coincidence with respective stations.

3. An apparatus as defined in claim 2, wherein the rotary turntable is mounted on a shaft adapted to move the turntable in intermittent 90° arcs and each of the carriers are located on a common radius at 90° intervals.

4. An apparatus as defined in claim 3, wherein means are provided for rotatably moving the turntable in a horizontal plane during 90° arc movements, and means are also provided for simultaneously raising the turntable as it is being rotated through a 90° arc.

5. An apparatus as defined in claim 1, wherein the second station is provided with a press platen and means for moving the press platen in a vertical axis such that it can be lowered to press solids into a sheet located on the filter medium in order to consolidate the fibers while they are still in a wet state.

6. An apparatus as defined in claim 5, wherein a suction box is provided under the turntable directly underneath the press platen such that vacuum can be applied to the sheet being formed on the filter medium in order to enhance the consolidation and drying the sheet thereon.

7. An apparatus according to claim 1, wherein the third station includes a heating plate, and means for moving the heating plate in a vertical direction to contact the sheet being formed on the filter medium so as to dry the sheet.

8. An apparatus as defined in claim 7, wherein a suction box is provided in the third station immediately below the filter medium such that a vacuum can be applied through the suction box to enhance the drying of the sheet on the filter medium.

9. An apparatus as defined in claim 1, wherein the fourth station includes a vacuum pick-up device, means for moving the pick-up device in a vertical axis and in a horizontal direction and an air pressure box provided below the carrier whereby air pressure can be applied to the bottom of the filter medium in order to disengage the sheets from the filter medium while a vacuum is provided in the pick-up means for removing and transfering the sheet from the carrier section in the fourth station.

10. An apparatus for forming paper comprising:

a carrier provided with a filter medium defining a mold suitable for forming a sheet of paper;

means for conveying said carrier sequentially to first, second, third, and fourth treatment stations said means comprising a turntable mounted for rotation about an vertical axis for rotating said carriers between stations;

said first station including means for supplying a fiber suspension liquid to said filter medium including a vertically movable column for receiving said liquid, said column being movable from a first position to a second position with one end thereof sealingly communicating with one side of said filter medium;

means for supplying said liquid to said column when said column is in the second position;

means located on a side opposite said one side for drawing liquid through said filter medium, whereby the fibers suspended in the liquid are deposited on said filter medium and mold forming the sheet of paper;

said second station comprising means for applying a pressure against said formed sheet whereby excess liquid is forced from said sheet through said filter medium;

said third station comprising heating means for drying the sheet whereby a removable sheet of paper is obtained from said filter medium; and said fourth station comprising a sheet pickup means adjacent the turntable and adapted to pickup and remove the sheet from the mold.

11. An apparatus as defined in claim 10, wherein the means for drawing the water through the filter medium includes a cylinder and a suction type piston provided in the cylinder whereby when the piston is moved downwardly in the cylinder, it will draw the water contained in the column through the filter medium of the carrier.

12. The apparatus of claim 10, wherein said means for supplying said liquid comprises:

a mixing tank containing fibers in suspension in a liquid forming a stock;

a measuring tank located above said column and connected thereto through a conduit and valve means for interrupting the flow of material gravity fed from said measuring tank to said column;

said measuring tank including an overflow outlet for maintaining a constant volume of stock; and means for supplying material from said overflow outlet to said mixing tank whereby material in excess of said constant volume is delivered from said measuring tank to said mixing tank.

13. An apparatus for forming paper comprising:

a carrier provided with a filtering medium defining a mold suitable for forming a sheet of paper;

means for conveying said carrier sequentially to first, second, third and fourth treatment stations, said means comprising a turntable mounted for rotation about a vertical axis, whereby said at least one carrier is rotated into each of said stations;

said first station including means for supplying a fiber suspension liquid to said filter medium and means for drawing said liquid through said filter medium whereby the solids are left on one side of said carrier forming a sheet;

said second station comprising means for applying a pressure against said formed sheet whereby excess liquid is forced from said sheet through said filter medium;

said third station comprising heating means for drying the sheet whereby a removable sheet of paper is obtained from said filter medium; and said fourth station comprising a vacuum pickup means movable along a vertical axis and along a horizontal axis, and a source of air pressure for applying air to a side of said carrier opposite said one side for forcing said sheet away from said filter medium into communication with said pickup means whereby said sheet is transferred from said carrier to said pickup means.

* * * * *